US005911649A

United States Patent [19]

Miller

[11] Patent Number: 5,911,649

[45] **Date of Patent: *Jun. 15, 1999**

[54] STATIONARY EXERCISE DEVICE

[76] Inventor: Larry Miller, 1628 Treeside, Rochester, Mich. 48307

[ * ] Notice: This patent is subject to a terminal disclaimer.

[21] Appl. No.: 08/795,036

[22] Filed: Feb. 5, 1997

Related U.S. Application Data

[63] Continuation of application No. 08/636,074, Apr. 22, 1996, Pat. No. 5,611,756, and a continuation-in-part of application No. 08/598,548, Feb. 8, 1996, Pat. No. 5,577,985.

[51] Int. Cl.[6] ..... A63B 69/16; A63B 22/00

[52] U.S. Cl. ..... 482/52; 482/57

[58] Field of Search ..... 482/51, 52, 53, 482/70, 71, 79–80, 148, 74

[56] References Cited

U.S. PATENT DOCUMENTS

| | | | |
|---|---|---|---|
| D. 372,282 | 7/1996 | Pasero et al. | D21/191 |
| 4,798,379 | 1/1989 | Jenkins | 272/73 |
| 5,039,088 | 8/1991 | Shifferaw | 272/73 |
| 5,356,356 | 10/1994 | Hildebrandt et al. | 482/62 |
| 5,423,729 | 6/1995 | Eschenbach | 482/51 |
| 5,499,956 | 3/1996 | Habing et al. | 482/51 |
| 5,529,555 | 6/1996 | Rodgers, Jr. | 482/51 |
| 5,549,526 | 8/1996 | Rodgers, Jr. | 482/51 |
| 5,562,574 | 10/1996 | Miller | 482/51 |
| 5,577,985 | 11/1996 | Miller | 482/51 |
| 5,611,756 | 3/1997 | Miller | 482/51 |

*Primary Examiner*—Stephen R. Crow
*Attorney, Agent, or Firm*—Gifford, Krass, Groh, Sprinkle, Anderson & Citkowski, P.C.

[57] ABSTRACT

An exercise device includes a frame having a set of guide links pivotally supported thereupon. Each guide link supports a foot engaging link at one end thereof. The guide links are reciprocated back and forth by a set of intermediate links which engage a set of cranks which rotate about a second pivot point. A control link joins the foot link to the intermediate link and operates to vary the angle between the guide links and the foot links, as the guide links reciprocate. This device provides a very natural running and stepping action for a user who is positioned on the foot links.

13 Claims, 3 Drawing Sheets

STATIONARY EXERCISE DEVICE

RELATED APPLICATION

This is a continuation of application Ser. No. 08/636,074 filed on Apr. 22, 1996, now U.S. Pat. No. 5,611,756, and is a continuation-in-part of U.S. patent application Ser. No. 08/598,548 filed Feb. 8, 1996 and entitled "Improved Stationary Exercise Device", now U.S. Pat. No. 5,577,985.

FIELD OF THE INVENTION

This invention relates generally to exercise equipment. More specifically, the invention relates to a compact, stationary exercise device for simulating running and stepping motions.

BACKGROUND OF THE INVENTION

Because of a growing appreciation for the benefits of regular exercise; and because constraints of time and space prevent many persons from indulging in activities such as running, swimming and walking, the market for exercise equipment is rapidly increasing. It is generally desirable to exercise a number of different muscles over a fairly large range of motion so as to provide for even physical development and a maximum level of aerobic exercise. It is further desirable that exercise equipment provide a smooth, relatively natural motion so as to avoid jarring or irregular strains which can damage muscles and joints. It is also desirable that exercise equipment be relatively easy to use and of simple, low cost construction.

While a number of different exercise systems are known in the prior art, such systems suffer from a number of shortcomings which limit their utility. Stationary bicycles are widely used; however, they are employed in a sitting position and consequently, the number of muscles exercised is small. Furthermore, the range of motion provided by a stationary bicycle is fairly limited. Stationary devices for simulating cross country skiing are also in widespread use. While these systems exercise more muscles than do stationary bicycles, the relatively flat, shuffling foot motion provided thereby does not adequately exercise all of the leg muscles through a wide range of motion. Stair climbing equipment also exercises more muscles than do stationary bicycles; however, the rather limited up and down motion provided thereby does not exercise leg muscles through a large range of motion. Treadmills and the like permit walking or jogging in a relatively limited area; however, they can be quite jarring to knee and ankle joints, and many users find it difficult to maintain balance on a treadmill.

U.S. Pat. No. 4,720,093 shows a climbing type exerciser. U.S. Pat. No. 4,509,742 shows a stationary bicycle which provides for arm motion. U.S. Pat. No. 2,603,486 shows a bicycle type exerciser providing for combined arm and leg motions. U.S. Pat. No. 5,039,088 shows another bicycle type exerciser providing for hand motion.

U.S. Pat. No. 3,316,898 discloses a rehabilitation device for passive use by a seated person. The device includes a motor which raises and lowers a set of foot supporting plates so as to flex the ankle, knee and hip joints. A similar device is shown in U.S. Pat. No. 4,185,622. German Laid Open Publication 29 19 494 discloses an exercise device in which a set of foot supporting plates disposed so as to undergo a combination of sliding and rotary motion to provide a stepping action. It has been found that while these apparatus produce a stepping motion, the motion does not simulate natural running and walking.

In response to the shortcomings of the prior art, the inventor of the present invention has previously developed a stationary exercise device which is disclosed in U.S. Pat. Nos. 5,242,343; 5,383,829, and application Ser. No. 08/407,272. The apparatus of the foregoing patents provides a natural running and stepping motion in which the user's heel initially rises at a faster rate than the toe, on a forward step, and in which the heel initially falls at a faster rate than the toe on a backward step. The present invention is directed to an exercise device which is configured differently from those in U.S. Pat. Nos. 5,242,343; 5,383,829 and application Ser. No. 08/407,272, but which achieves a similar, beneficial foot action.

The apparatus of the present invention is simple to manufacture and use, compact in design, and provides a smooth, natural action which exercises a relatively large number of muscles through a large range of motion. These and other advantages of the present invention will be readily apparent from the drawings, discussion and description which follow.

BRIEF DESCRIPTION OF THE INVENTION

There is disclosed herein an exercise device which includes a frame configured to be supported on a floor and including a first and a second pivot axis defined thereupon. The device further includes a first and a second guide link, each having a first and second attachment point defined thereupon. Each guide link is pivotably attached to the first pivot axis of the frame through its first attachment point. The device includes a first and second foot link, each of which is pivotally attached to a respective one of the guide links through the second attachment point thereof. A first and a second crank arm are each pivotally attached to the frame at the second pivot axis so as to be rotatable thereabout, and a first and second intermediate link each have a first connection point mechanically coupled to a respective one of the guide links and a second connection point mechanically coupled to a respective one of the crank arms, so that rotation of the first and second arms about the pivot axis causes the first and second guide links to pivot about the first pivot axis. The device further includes a first and second control link, each having a first end mechanically coupled to a respective one of the foot links, and a second end mechanically coupled to a respective one of the intermediate links. The control links are operative to vary the angle defined between the foot link and the guide link as the guide link pivots about the first pivot axis.

In one embodiment, the first and second intermediate links are each coupled to their respective guide links at a third attachment point defined on each of the guide links between the first and second attachment points. In other embodiments, the second end of each of the control links is mechanically coupled to an intermediate link at a contact point thereupon between the first and second connection points of the intermediate link, and in particular embodiments, this contact point is adjustable. In other embodiments, the contact point between the control link and the foot link is adjustable.

In certain embodiments, the exercise device includes a flywheel mechanically engaged with the first and second crank arms. In some instances, the flywheel may be supported at the second pivot axis, whereas in other instances the flywheel may be supported at a point separate from the second pivot axis, and mechanically coupled to the first and second crank arms by a chain or belt so that the crank arms rotate about the second pivot axis as the flywheel rotates. In yet other instances, the first and second guide links may include hand grip extensions projecting therefrom.

DETAILED DESCRIPTION OF THE INVENTION

Figure 1:
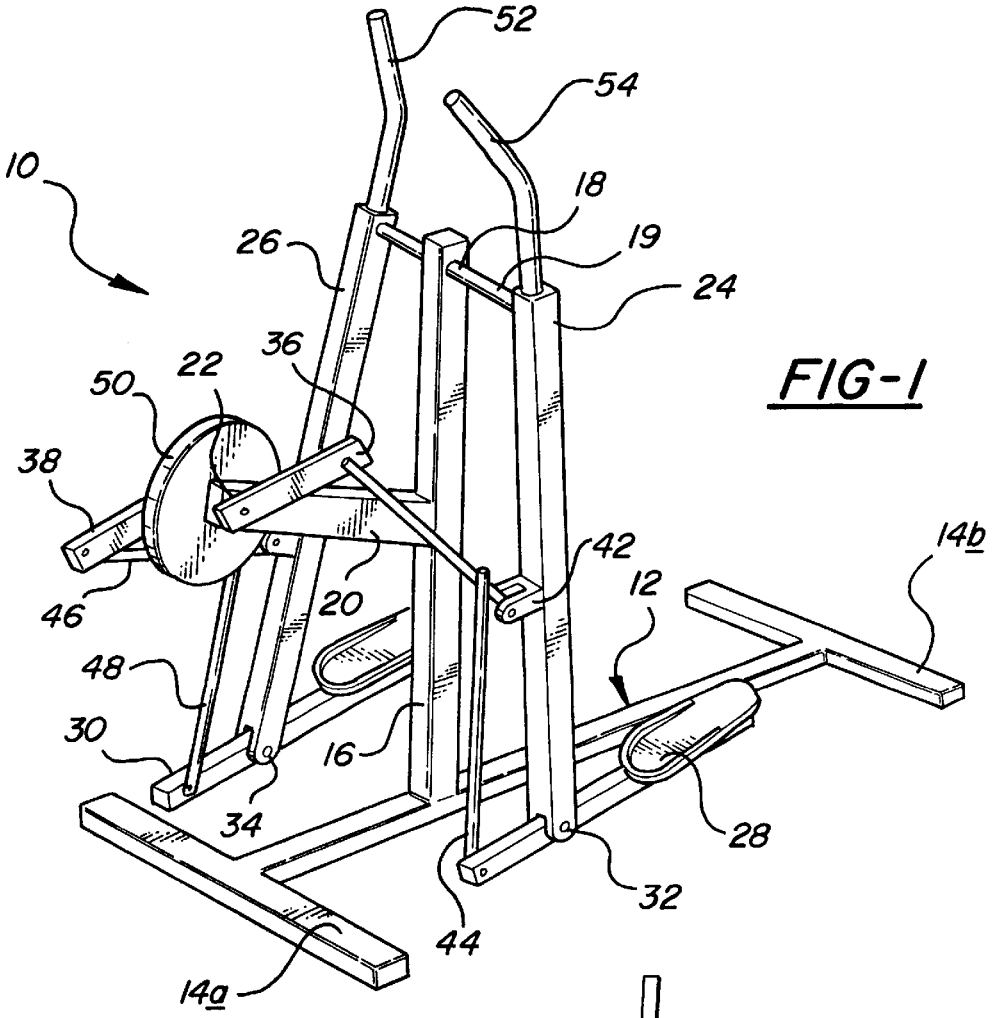
FIG. 1 is a perspective view of one embodiment of an exercise device structured in accord with the principles of the present invention.

The present invention is directed to a stationary exercise device that provides a range of motion which simulates a natural running and stepping motion. The apparatus is relatively compact in design, and may be implemented in a variety of configurations. Referring now to FIG. 1, there is shown a perspective view of one embodiment of exercise device 10 structured in accord with the principles of the present invention.

The device 10 of FIG. 1 includes a frame 12 which is configured to be supported on a floor and which supports the remainder of the apparatus. The frame 12 includes a pair of legs 14*a,* 14*b* which support and stabilize the remainder of the apparatus on the floor. Frame 12 further includes an upright support 16 having a first fixed pivot axis 18 therein. As illustrated, this pivot axis is defined by a shaft 19. A support arm 20 projects from the upright 16 of the frame 12 and further includes a second fixed pivot axis 22 therein defined by a second shaft.

A first, 24, and a second, 26, guide link are pivotably attached to the frame at the first pivot point 18 so that the guide links 24, 26 are free to pivot thereabout. As illustrated, the guide links 24, 26 are attached to the upright 16 of the frame 12 at a first attachment point, which engages the shaft 19.

The apparatus of FIG. 1 includes a first foot link 28 and a second foot link 30. Each foot link 28, 30 is configured to engage and support a user's foot. The foot links 28, 30 are each coupled to a respective one of the guide links by a pivotable connection established at a second attachment point on each guide link. As illustrated, the first foot link 28 is attached to its respective first guide link 24 by a pivotable connection 32. The second foot link 30 is similarly attached to its respective second guide link 26 by a second pivotable connection 34. The apparatus of FIG. 1 further includes a first crank arm 36, and a second crank arm 38 disposed so as to rotate about the second pivot axis 22.

A first intermediate link 40 has its first end mechanically connected to the first guide link 24, and its second end mechanically connected to the first crank 36. As illustrated, the first intermediate link 40 is connected to the first guide link 24 at an attachment point 42, defined on said first guide link 24 at a location between the point at which the guide link is joined to the first pivot axis 18 and the point at which the guide link is pivotally attached to the first foot link 28; although, it is to be understood that the intermediate link 40 may be attached to the guide link 24 at another location, including a location at or near the pivotable attachment 32 of the foot link 28. Within the context of this disclosure the points at which the various members comprising the present invention are joined together may be selectably varied so as to adjust the exercise device. Consequently when a link or other such member is described as having an end coupled to another member, it is to be understood that the connection point therebetween may be adjusted along the length of the member, with that connection point effectively forming the end of the member.

Because of the particular mechanical arrangement of the crank arm 36, intermediate link 40 and guide link 24, the intermediate link will operate to cause the guide link 24 to pivot about the first pivot axis 18 in a reciprocal motion, as the crank 36 rotates about the second pivot axis 22. This will in turn reciprocate the foot link 28.

In order to assure proper foot motion, the exercise apparatus of the present invention further includes a first control link 44 having a first end mechanically coupled to the first foot link 28, and a second end mechanically coupled to the first intermediate link 40. The control link 44 cooperates with the intermediate link 40, guide link 44 and foot link 28 to regularly, and repetitively, vary the angle defined between the guide link 24 and foot link 28 as the guide link 24 is pivoted about the first pivot axis 18 under the influence of the first crank arm 36 and intermediate link 40. In this manner, the mechanical arrangement assures a proper and beneficial foot motion, as will be described in greater detail hereinbelow.

The apparatus of the present invention includes a mirror image series of linkages controlling the motion of the second foot link 30. Specifically, the apparatus further includes a second intermediate link 46 joining the second crank arm 38 to the second guide link 26. A second control link 48 joins the second foot link 30 to the second intermediate link 46.

As illustrated, the apparatus 10 of FIG. 1 further includes a flywheel 50, supported at the second pivot axis 22. The flywheel is in mechanical engagement with the first crank 36 and the second crank 38. While the inclusion of the flywheel is not necessary for the function of the present invention, it has been found that the presence of a flywheel serves to enhance the action of the exercise device by providing a smooth and even motion. As further illustrated, the apparatus 10 includes a set of hand grips 50, 52 which project from guide links 24, 26. The hand grips 50, 52 are adapted to be gripped by a user of the apparatus and to reciprocate along with the guide links 24, 26 to provide upper body exercise. As illustrated, the hand grips 50, 52 are angled so as to further enhance the upper body action. Various other modifications may be implemented in accord with the present invention. For example, a stationary hand grip may be mounted onto the frame 12 and may supplement, or replace, the hand grips 50, 52. In some instances, a braking device, such as a friction brake or other mechanical brake, a magnetic brake, or an electrical brake may be included in the exercise device so as to permit selectable enhancement of the amount of effort required to utilize the device. Other such modifications will also be apparent to one of skill in the art. For example, a fan device may be incorporated into the apparatus to provide a stream of cooling air to the user. In one particular embodiment, the fan may be powered by, or integral with, the flywheel 50, whereas in other embodiments, the fan may be separate therefrom.

Figure 2:
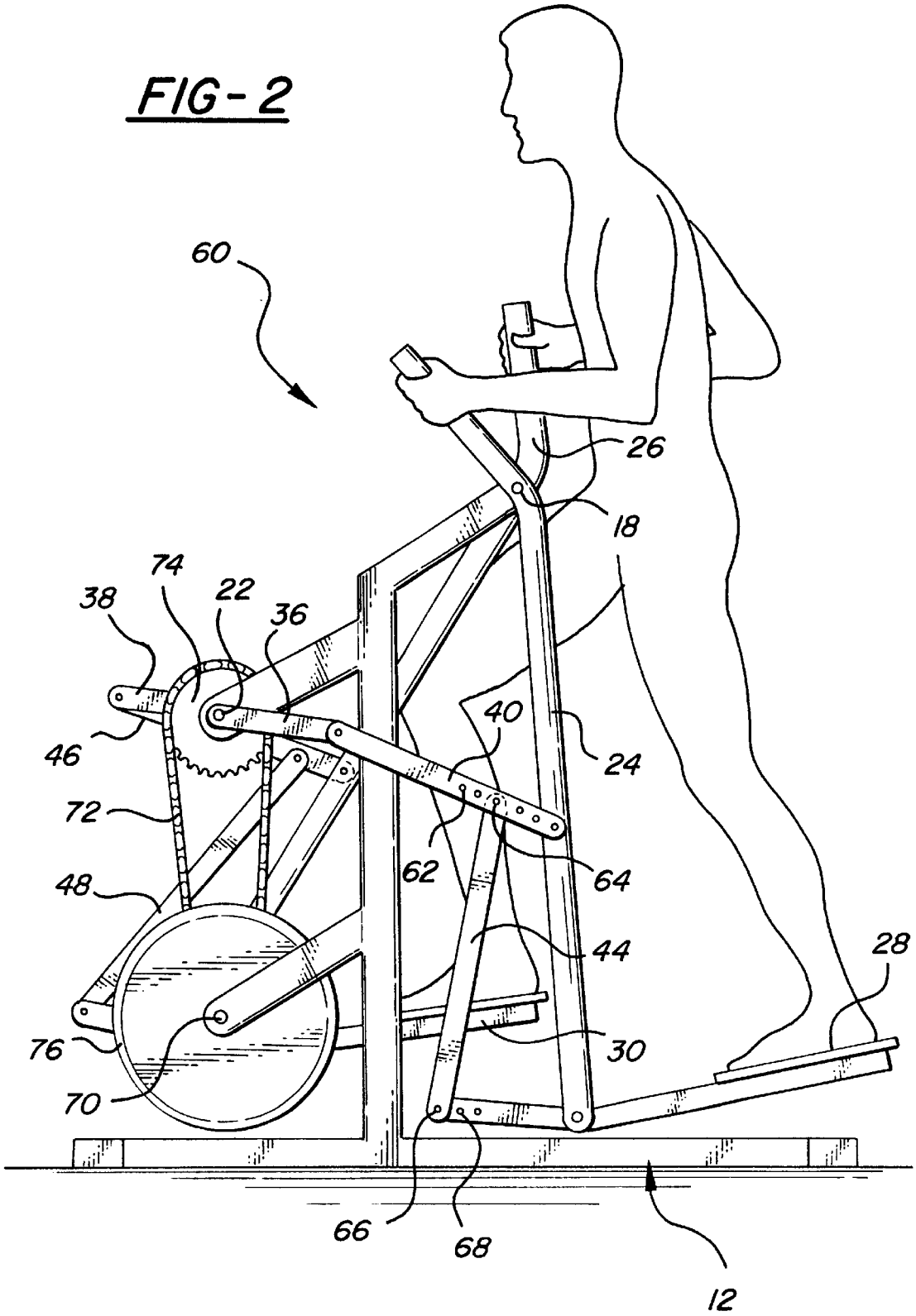
FIG. 2 is a side elevational view of yet another embodiment of an exercise device structured in accord with the principles of the present invention.

Referring now to FIG. 2, there is shown another embodiment of exercise device 60 structured in accord with the principles of the present invention. The device 60 of FIG. 2 is generally similar to device 10 of FIG. 1, and like elements therein will be referred to by like reference numerals.

The exercise device 60 of FIG. 2 includes a frame 12 having a first fixed pivot axis 18 and a second fixed pivot axis 22 defined thereupon. As in the previous embodiment, the device 60 includes a first and second guide link 24, 26 respectively. The guide links 24, 26 are pivotally attached to the frame 12 at the first pivot point 18, and each includes a foot link 28, 30 pivotally attached thereto. Crank arms 36 and 38 are supported for rotation about the second pivot axis 22, and each crank arm is connected to a respective foot link 24, 26 via an intermediate link 40, 46. A pair of control links 44 and 48 join the foot links 28, 30 to their respective intermediate links 40, 46, as previously described.

The exercise device 60 of FIG. 2 differs from device 10 of FIG. 1 in several regards. As illustrated, the attachment point between the control link 44 and its associated intermediate link 40, may be selectably adjusted, as may be the attachment point between the control link 44 and its associated foot link 28. As illustrated, the intermediate link 40 includes a series of holes 62, defined therein, and the control link 44 includes a coupler 64, such as a detent pin having a ball lock therein, for permitting repositioning of the control link 44 with regard to the intermediate link 40. A similar connection may be established by a threaded connector such as a nut and bolt combination or the like. In other embodiments, the control link 44 and intermediate link 40 may be configured so as to slidably engage one another, and may include an immobilizing screw to fix the attachment point. A similar arrangement may be present at the attachment point of the control link 44 and foot link 28. As illustrated, the device 60 includes a series of holes 68 in the first link 28, and a fastener 66, as previously described, for joining the control link 44 to the foot link 28. It will be appreciated that by varying the attachment points between the links, the angular relationship of the foot link 28 to the guide link 24, in response to pivoting of the guide link 24, may be made to vary. In the FIG. 2 embodiment, the connection between the second control link 48 and the second intermediate link 46, and the second foot link 30, includes a similar arrangement for permitting repositioning of the attachment point.

The FIG. 2 embodiment 60 further differs from that of FIG. 1 insofar as the frame includes a third pivot axis 70 defined thereupon. A flywheel 76 is supported at the third pivot point 70 and is mechanically coupled to the cranks 36, 38 by means of a drive chain 72 which engages a sprocket 74, which in turn is supported at the second pivot point 22. This mechanical arrangement removes the flywheel from the second pivot point thereby permitting use of a larger flywheel, and lowering the center of gravity of the machine. While the coupling is illustrated as being via a sprocket and chain, clearly other coupling arrangements such as a drive belt, gears or the like may be employed. Various other modifications of the invention will be apparent to one of skill in the art. For example, in some instances, the cranks may be rotated by means of a motor. This embodiment may be advantageous in situations where the exercise device is used for rehabilitative purposes.

Figure 4:
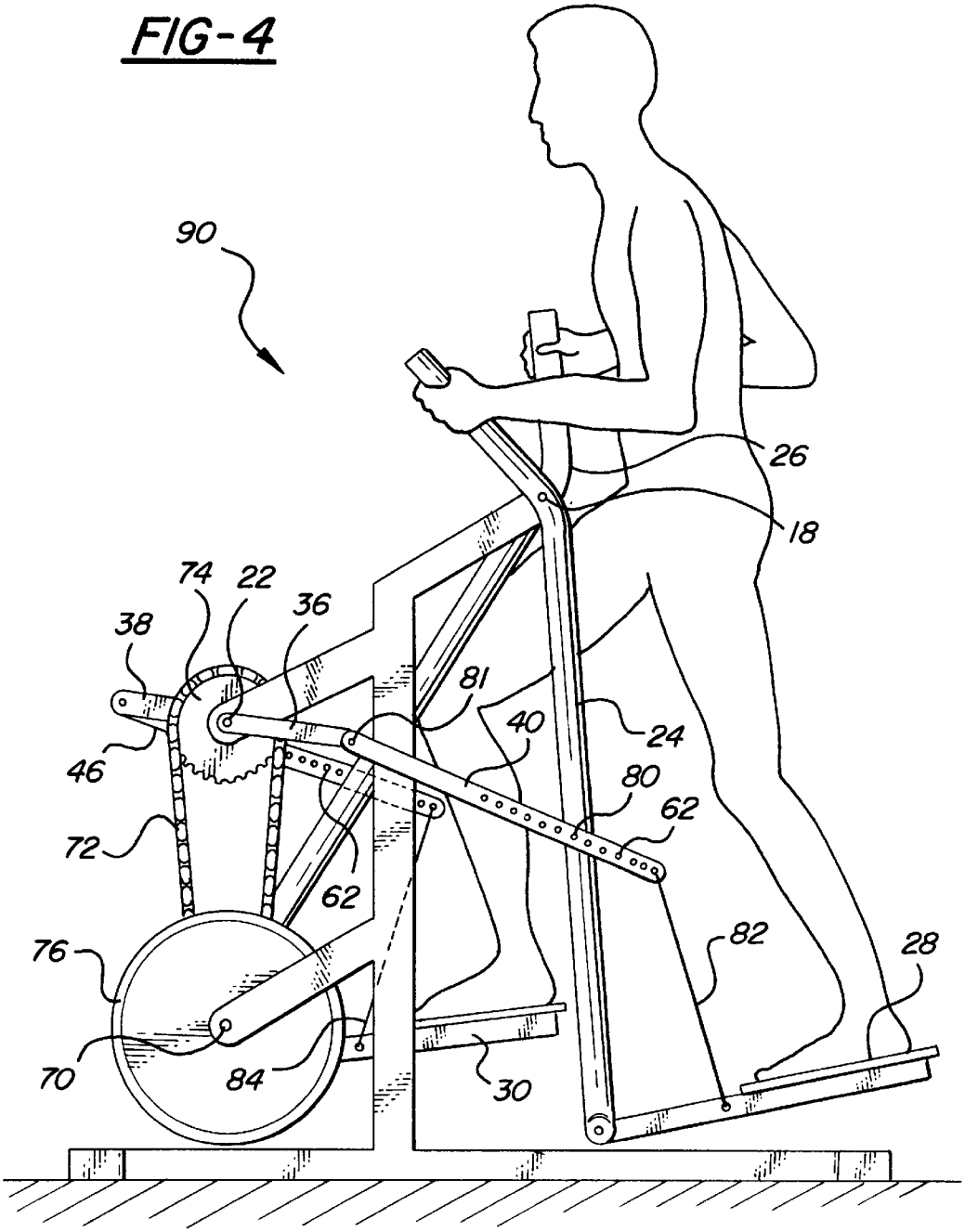
FIG. 4 is a side elevational view of another embodiment of exercise device structured in accord with the principles of the present invention.

Other embodiments of exercise device may be implemented in accord with the present invention. Referring now to FIG. 4, there is shown yet another exercise device of the present invention. The device 90 of FIG. 4 is somewhat similar to the device 60 of FIG. 2, and accordingly, like structures will be referred to by like reference numerals. The device 90 of FIG. 4 includes a frame supporting a pair of guide links 24 and 26, and further includes a flywheel arrangement, as described above, operative to rotate a pair of crank arms 36, 38. A pair of intermediate links 40 and 46 are coupled to respective crank arms, and to respective guide links 24, 26.

As specifically illustrated in FIG. 4, the intermediate links, for example link 40, are connected to their respective guide links, for example link 24, at a first connection point 80. In the FIG. 4 embodiment, an outboard portion of the intermediate link 40 projects from the first connection point 80 (also referred to as the first end of the intermediate link 40 in the context of this disclosure). A control link 82 connects the outboard portion of the intermediate link 40 to the foot link 28, and operates as previously described to vary the angle between the foot link 28 and associated guide link 24 as the guide links pivots about first pivot axis 18.

In the illustrated embodiment, the control link 82 may be fabricated from a length of cable, since the illustrated design maintains the control link 82 in tension at all times in its operational cycle. As previously described, the positional attachment between the control link 82 and the foot link 28 may be positionally adjusted, as may be the first connection point 80 between the intermediate link 40 and guide link 24, as may also be the second connection point 81 between the intermediate link 40 and associated crank arm 36. A mirror image arrangement of parts is provided in connection with the other intermediate link 46 and foot link 30, and as illustrated includes a second control link 84 also comprising a cable in this specific embodiment.

Figure 3:
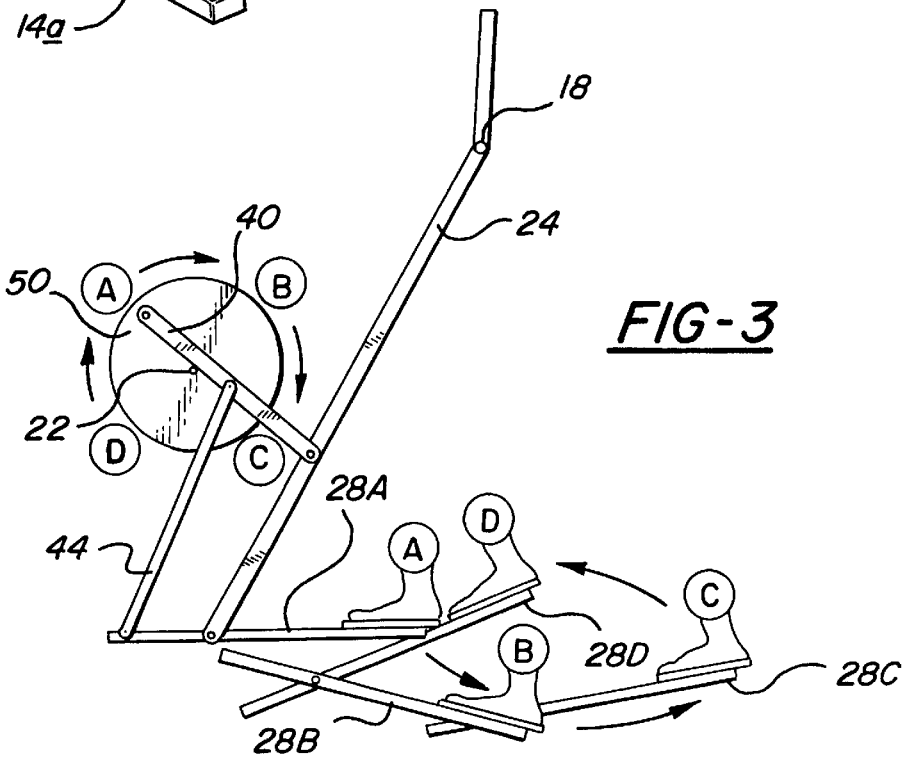
FIG. 3 is a schematic depiction of a portion of an exercise device structured in accord with the principles of the present invention, illustrating the foot movement achieved thereby.

It has been found that the exercise device of the present invention provides a very natural action which simulates running and stepping motions. Referring now to FIG. 3, there is shown a simplified and schematic depiction of the foot motion achieved by the apparatus of the present invention. Shown in FIG. 3 is an abbreviated depiction of a portion of the mechanical linkage of the present invention including a guide link 24 supported at a first pivot point 18, a foot link 28 attached to the guide link 24; and an intermediate link 40 which has one of its ends attached to the guide link 24, and the other of its ends attached to a flywheel 50 near the periphery thereof. Flywheel 50 is disposed for rotation about second pivot axis 22. In the illustrated embodiment, a discrete crank, separate from the flywheel 50, is not employed, and in this instance the crank is comprised of a radial segment of the flywheel 50 extending from the pivot axis 22 to the attachment point of the intermediate link 40. As previously described, a control link 44 joins the intermediate link 40 and the foot link 28.

As illustrated in FIG. 3, the foot link 28 is shown in four separate positions 28*a*–28*d*. The foot link travels through this series of positions as the flywheel rotates through the correspondingly indicated positions A–D thereby driving the intermediate link 40, guide link 24 and control link 44. For clarity of illustration, these links have only been shown in the initial position corresponding to position a. As the flywheel rotates from position A to position B, the aforedescribed linkages move the foot link 28*a* to the position indicated at 28*b*, and it will be noted that the foot travels backward and downward, with the heel initially falling at a faster rate than the toe. As the wheel 50 rotates to position c, the foot continues to travel backward, but upward, to position c. From position c, the foot travels to position d by moving upward and forward, and as it moves forward, the heel rises at a faster rate than the toe. This motion simulates natural walking and stepping actions. This action has been found to provide comfortable and beneficial exercise.

It will be appreciated that a number of embodiments of exercise device, other than those described hereinabove, may be implemented in accord with the resent invention so as to achieve the beneficial running and stepping motion described with reference to FIG. 3. For example, the control means for varying the angle between the foot link and guide link may comprise a pair of cables, one of which is associated with each foot link. Each cable runs from its respective foot link to a pulley supported on the frame (or alternatively on a guide link) and on to one of the crank arms. This system avoids connection of the cable to the intermediate link, but still achieves the same beneficial range of motion obtained with the other embodiments of the present invention. In another variation of the foregoing, the angle of the foot links is controlled by a linkage including a bell crank supporter on the frame. The bell crank includes first and second arms coupled to respective foot links by cables, rods or the like, and to respective crank arms by rigid linkages. In this particular embodiment, the bell crank and linkage substitute for the aforedescribed pulleys and cables. Other control means for varying the angle of the foot links will also be apparent to one of skill in the art, as will be means for accomplishing the other functions of the apparatus of the present invention. For example, the intermediate links and/or crank arm arrangement used to pivot the guide links may be substituted for by cables, cams, pulleys and like mechanical equivalents, all of which are within the scope of the present invention.

It is to be understood that the foregoing drawings, discussion and description are illustrative of particular embodiments of the invention, but are not meant to be limitations upon the practice thereof. Numerous modifications and variations will be apparent to one of skill in the art in view of the disclosure herein. It is the following claims, including all equivalents, which define the scope of the invention.

We claim:

1. An exercise device comprising:

a frame having a first and second pivot axis defined thereupon;

a first and a second guide link, each guide link having a first and a second attachment point defined thereupon, each guide link being pivotally attached, through its first attachment point, to said frame at the first pivot axis thereof;

a first and a second foot link, each foot link being configured to receive a foot, and each foot link being pivotally attached to a respective one of said first and second guide links through the second attachment point thereof;

coupling means coupled relative to the second pivot axis to rotate thereabout, and operably associated with said guide links for causing said guide links to pivot about said first pivot axis as said coupling means rotate about said second pivot axis;

a first and a second crank arm, each being pivotally attached to said frame at said second pivot axis so as to be rotatable thereabout;

a first and a second intermediate link, each having a first connection point mechanically coupled to a respective one of said guide links and a second connection point mechanically coupled to a respective one of said crank arms; and control means mechanically associated with said foot links, said control means being operative to vary an angle defined between one of said foot links and its associated guide link as said guide link pivots about said first pivot axis.

2. An exercise device according to claim 1, further including a flywheel in mechanical engagement with said first and second crank arms.

3. An exercise device according claim 2, wherein said flywheel is supported at a pivot axis separate from said second pivot axis, and wherein said flywheel is mechanically coupled to said first and second crank arms so that said first and second crank arms rotate about said second axis as said flywheel rotates.

4. An apparatus according to claim 1, wherein said control means comprising a first and second control link, each having a first end operably coupled to a respective one of said foot links, and a second end portion operably coupled to a respective one of said intermediate links, each of said control links being operative to vary an angle defined between its respective foot link and its associated guide link, as said guide link pivots about said first pivot axis.

5. An exercise apparatus according to claim 4, wherein the second end of each said control links is mechanically coupled to its respective intermediate link at a contact pint thereupon between the first connection point and a second connection point thereof.

6. An exercise apparatus according to claim 5, wherein the contact point of said control link and intermediate link is adjustable.

7. An exercise apparatus according to claim 4, wherein the first end of each of said first and second control links is coupled to a respective one of said foot links at a contact point, wherein said contact point is adjustable.

8. An exercise apparatus according to claim 4, wherein the first and second control links each comprise a cable.

9. An exercise device comprising:

a frame having a first and second pivot axis defined thereupon;

a first and a second guide link, each guide link having a first and a second attachment point defined thereupon, each guide link being pivotally attached, through its first attachment point, to said frame at the first pivot axis thereof;

a first and a second foot link, each foot link being pivotally attached to a respective one of said first and second guide links through the second attachment point thereof;

coupling means coupled relative to the second pivot axis to rotate thereabout, and operably associated with said guide links for causing said guide links to pivot about said first pivot axis as said coupling means rotate about said second pivot axis; and control means comprising a first and a second control link, each control link having a first end portion operably coupled to a respective one of said foot links, and a second end portion operably coupled to the coupling means, each of said control links being operative to vary an angle defined between its respective foot link and its associated guide link, as said guide link pivots about said first pivot axis.

10. An exercise device comprising:

a frame;

first and second foot links;

a first and second guide link, each guide link pivotally supported by the frame, and each being pivotally coupled to a respective foot link;

first and second control links, each control link being pivotally connected to a respective foot link at a location spaced from the location that the guide link is coupled thereto, said guide links and control links supporting the first and second foot links for movement relative to the frame;

a coupling system for each foot link, said coupling system including at least one member which rotates relative to a pivot axis, said coupling system operably associated with at least one of said guide links and control links and operative to cause said guide links to pivot relative to the frame whereby said foot links also move relative to said frame; and control means associated with at least one of said guide links and control links, and operable to control the angle of the foot links relative to the frame during movement of the foot links.

11. An exercise device comprising:

a frame;

first and second foot links;

a first support link for each of the foot links, each first support link having an upper end portion pivotally supported by the frame and a lower end portion pivotally coupled to a respective foot link;

a second support link for each of the foot links, each second support link having a lower end portion connected to a respective foot link at a location spaced from the location that the first support link is coupled to the foot link, the first and second support links supporting the first and second foot links for movement relative to the frame;

a coupling system for each foot link, the coupling system coupled relative to a pivot axis to rotate thereabout, the coupling system operably associated with at least one of the first and second support links to cause the first support link to pivot at its upper end portion resulting in associated movement of the first and second foot links; and control means associated with at least one of the first and second support links to control the angle of the foot links relative to the frame during movement of the foot links.

12. The exercise device according to claim 10 wherein:

the first and second foot links each have a forward end portion and a rearward end portion; and the first support link is coupled to a respective foot link at a location forwardly along the foot link from the location that the second support link is coupled to the respective foot link.

13. The exercise device of claim 10 wherein:

the first and second support links each have a forward end portion and a rearward end portion; and the first support link is coupled to a respective foot link at a location rearwardly along the foot link from the location that the second support link is coupled to a respective foot link.

* * * * *

UNITED STATES PATENT AND TRADEMARK OFFICE

CERTIFICATE OF CORRECTION

PATENT NO. : 5,911,649

DATED : June 15, 1999

INVENTOR(S) : Larry Miller

It is certified that error appears in the above-identified patent and that said Letters Patent is hereby corrected as shown below:

Column 1, line 63-Insert --is--after "plates".
Column 2, line 36-Delete the word "have" and insert the word--has--.
Column 4, line 23- Delete the number "44" and insert the number --24--.
Column 4, line 45-Delete the numbers "50,52" and insert the numbers --52, 54--.
Column 4, line 46-Delete the numbers "50,52" and insert the numbers--52, 54--.
Column 4, line 49-Delete the numbers "50, 52" and insert the numbers--52,54--.
Column 4, line 54-Delete the numbers "50, 52" and insert the numbers --52, 54--.
Column 5, line 12- Delete the word "f oot" and insert the word--guide--.
Column 5, line 34-Delete the word "first" and insert the word --foot--.
Column 6, line 15-Insert --the--after "about"
Column 8, line 8-Delete the word "comprising" and insert the word--comprises--.
Column 8, line 16-Delete the word "pint" and insert the word --point--.
Column 10, line 10- Delete the number "10" and insert the number --11--.
Column 10, line 17-Delete the number "10" and insert the number --11--.
Column 10, line 18-Delete the word "support" and insert the word --foot--.

Signed and Sealed this

Twenty-fifth Day of April, 2000

*Attest:*

*Attesting Officer*

Q. TODD DICKINSON

*Director of Patents and Trademarks*